US009039490B2

(12) United States Patent
Kelly et al.

(10) Patent No.: US 9,039,490 B2
(45) Date of Patent: May 26, 2015

(54) METHOD OF SHAPING AN EDGE OF AN AEROFOIL

(75) Inventors: John R. Kelly, Belfast (GB); Adam S. Ramsay, Cramlington (GB); Satyaswaroop Nanda, Bangalore (IN); Fiona M. Halliday, Derby (GB)

(73) Assignee: ROLLS-ROYCE plc, London (GB)

( * ) Notice: Subject to any disclaimer, the term of this patent is extended or adjusted under 35 U.S.C. 154(b) by 353 days.

(21) Appl. No.: 13/479,881

(22) Filed: May 24, 2012

(65) Prior Publication Data

US 2012/0309274 A1 Dec. 6, 2012

(30) Foreign Application Priority Data

Jun. 3, 2011 (GB) ..... 1109303.6

(51) Int. Cl.

| | |
|---|---|
| ***B23P 9/00*** | (2006.01) |
| ***F01D 5/00*** | (2006.01) |
| *B24B 19/14* | (2006.01) |

(52) U.S. Cl.

CPC ..... *F01D 5/005* (2013.01); *B24B 19/14* (2013.01); *F05D 2230/80* (2013.01)

(58) Field of Classification Search

CPC ..... B24B 9/00; B24B 19/14; B24D 13/10; B24D 13/14; B24D 13/145; F01D 5/12

USPC ..... 29/81, 889.1; 72/465.1; 451/42, 44, 45, 451/57, 59, 66, 67, 192, 196, 262, 58

See application file for complete search history.

(56) References Cited

U.S. PATENT DOCUMENTS

| | | | | |
|---|---|---|---|---|
| 3,473,181 | A * | 10/1969 | Leonard | 15/77 |
| 5,105,583 | A * | 4/1992 | Hammond et al. | 451/271 |
| 5,281,062 | A * | 1/1994 | Dunkman et al. | 409/179 |
| 5,600,861 | A * | 2/1997 | Saito | 15/88.2 |
| 6,302,625 | B1 | 10/2001 | Carey et al. | |
| 6,969,300 | B2 * | 11/2005 | Himmer | 451/10 |
| 7,032,279 | B2 * | 4/2006 | McCarvill et al. | 29/90.01 |
| 7,261,500 | B2 * | 8/2007 | Killer et al. | 409/132 |
| 7,632,171 | B2 * | 12/2009 | Heesemann | 451/66 |

(Continued)

FOREIGN PATENT DOCUMENTS

| | | |
|---|---|---|
| DE | 10 2006 036 839 A1 | 2/2008 |
| WO | WO 2008/001043 A1 | 1/2008 |

(Continued)

OTHER PUBLICATIONS

Sep. 28, 2011 Search Report issued in British Patent Application No. GB1109303.6.

*Primary Examiner* — Timothy V Eley
(74) *Attorney, Agent, or Firm* — Oliff PLC

(57) ABSTRACT

An apparatus for shaping an edge of an aerofoil, the apparatus having first and second brushes and each brush having a plurality of bristles. A first motor rotates the first brush about a first axis and a second motor rotates the second brush about a second axis. The axes are arranged substantially parallel to the bristles of the respective brush. A support structure holds the first brush such that the first axis intersects a first surface of the edge of the aerofoil and holds the second brush such that the second axis intersects a second surface of the edge of the aerofoil. There are means to produce relative movement the first and second brushes and the aerofoil such that the first and second brushes move longitudinally along the edge of the aerofoil to shape the edge of the aerofoil.

13 Claims, 4 Drawing Sheets

(56) References Cited

U.S. PATENT DOCUMENTS

| | | | | |
|---|---|---|---|---|
| 8,651,921 | B2 * | 2/2014 | Clark et al. | 451/163 |
| 2004/0058629 | A1 * | 3/2004 | Weber | 451/260 |
| 2007/0026773 | A1 * | 2/2007 | Vogel | 451/469 |
| 2008/0064304 | A1 * | 3/2008 | Iga | 451/57 |
| 2009/0113683 | A1 | 5/2009 | Secherling | |
| 2009/0193601 | A1 * | 8/2009 | Tan et al. | 15/160 |
| 2009/0249623 | A1 | 10/2009 | Holze et al. | |
| 2010/0071209 | A1 * | 3/2010 | Moller | 29/889.7 |
| 2012/0304465 | A1 * | 12/2012 | Subbiah et al. | 29/889.1 |
| 2014/0134926 | A1 * | 5/2014 | Groppe et al. | 451/28 |
| 2014/0194038 | A1 * | 7/2014 | Lowe | 451/11 |

FOREIGN PATENT DOCUMENTS

| | | | |
|---|---|---|---|
| WO | WO 2010/003512 | A1 | 1/2010 |
| WO | WO 2010/091812 | A2 | 8/2010 |

* cited by examiner

METHOD OF SHAPING AN EDGE OF AN AEROFOIL

The present invention relates to an apparatus and a method of shaping an edge of an aerofoil and in particular to an apparatus and method of shaping a leading edge of a gas turbine engine fan blade or compressor blade.

The leading edges of fan blades and/or compressor blades of gas turbine engines suffer from erosion during operation due to particles flowing into the intake of the gas turbine engine impacting and eroding the leading edges of the fan blades and/or the leading edges of the compressor blades. The leading edges of the fan blades and the compressor blades are generally provided with a profiled leading edge, e.g. an elliptical leading edge, for optimum aerodynamic efficiency. However, during operation of the gas turbine engine the impacts of particles on the leading edges of the fan blades and/or the leading edges of the compressor blades erodes and blunts the leading edges of the fan blades and/or the leading edges of the compressor blades. The blunting of the leading edges of the fan blades and/or the leading edges of the compressor blades reduces the efficiency and/or the flutter margin of the fan and/or compressor of the gas turbine engine.

There is a need for an apparatus and a method to shape, or re-shape, the leading edge of a fan blade or compressor blade of a gas turbine engine.

Accordingly the present invention provides an apparatus for shaping an edge of an aerofoil, the apparatus comprising a first brush and a second brush, each brush comprising a plurality of bristles extending substantially parallel to each other, a first device arranged to rotate the first brush about a first axis, the first axis being arranged substantially parallel to the bristles of the first brush, a second device arranged to rotate the second brush about a second axis, the second axis being arranged substantially parallel to the bristles of the second brush, a support structure arranged to hold the first brush such that the first axis intersects a first surface of an edge of an aerofoil and arranged to hold the second brush such that the second axis intersects a second surface of the edge of the aerofoil, means to move the first brush such that the first brush contacts the first surface of the edge and means to move the second brush such that the second brush contacts the second surface of the edge, means to produce relative movement between the first brush and the second brush and the aerofoil such that the first brush and the second brush move longitudinally along the edge of the aerofoil to shape the edge of the aerofoil.

The apparatus may comprise a plurality of first brushes and a plurality of second brushes, each brush comprising a plurality of bristles extending substantially parallel to each other, a first device arranged to rotate each first brush about a respective first axis, each first axis being arranged substantially parallel to the bristles of the respective first brush, a second device arranged to rotate each second brush about a respective second axis, each second axis being arranged substantially parallel to the bristles of the respective second brush, a support structure arranged to hold the plurality of first brushes such that each first axis intersects a first surface of an edge of an aerofoil and arranged to hold the plurality of second brushes such that each second axis intersects a second surface of the edge of the aerofoil, means to move the plurality of first brushes such that the first brushes contact the first surface of the edge and means to move the plurality of second brushes such that the second brushes contact the second surface of the edge, means to produce relative movement between the plurality of first brushes and the plurality of second brushes and the aerofoil such that the plurality of first brushes and the plurality of second brushes move longitudinally along the edge of the aerofoil to shape the edge of the aerofoil.

The support structure may be arranged to hold each of the first and second brushes such that each first axis and each second axis intersect the first and second surfaces respectively at angle in the range of 30° to 75°.

The support structure may be arranged to hold each of the first and second brushes such that each first axis and each second axis intersect the first and second surfaces respectively at angle of 55° to 75°.

The support structure may be arranged to hold each of the first and second brushes such that each first axis and each second axis intersect the first and second surfaces respectively at angle of 60°.

The support structure may comprise an adjuster to vary the angle at which the first axis and the second axis of each of the first and each second brushes intersect the first and second surfaces respectively.

Each first brush may comprise alumina bristles or silicon carbide bristles. Each second brush may comprise alumina bristles or silicon carbide bristles.

The first device may comprise an electric motor, a hydraulic motor or a pneumatic motor and the second device may comprise an electric motor, a hydraulic motor or a pneumatic motor or the first device and the second device may comprise a single electric motor, a single hydraulic motor or a single pneumatic motor.

The first axis and the second axis may be arranged in a plane. Alternatively the first axis and the second axis may be arranged in two parallel planes.

The first device may comprise a first motor. The first motor may comprise an electric motor, a hydraulic motor or a pneumatic motor. The first device may comprise gears. The first device may comprise one or more drive shafts and the drive shaft may be a flexible drive shaft. The first motor may be arranged to drive the first brush via the gears and drive shaft or drive shafts. The first motor may be arranged to drive the first brush directly. The second device may comprise a second motor. The second motor may comprise an electric motor, a hydraulic motor or a pneumatic motor. The second device may comprise gears. The second device may comprise one or more drive shafts and the drive shaft may be a flexible drive shaft. The second motor may be arranged to drive the second brush via the gears and drive shaft or drive shafts. The second motor may be arranged to drive the second brush directly. The first device and the second device may share a single motor arranged to drive the first device and the second device. The single motor may be arranged to drive the first brush and the second brush via the respective gears and respective drive shaft or respective drive shafts.

The present invention also provides a method of shaping an edge of an aerofoil, the method comprising a) providing a first brush and a second brush, each brush comprising a plurality of bristles extending substantially parallel to each other, b) rotating the first brush about a first axis and rotating the second brush about a second axis, the first axis being arranged substantially parallel to the bristles of the first brush and the second axis being arranged substantially parallel to the bristles of the second brush, c) arranging the first axis to intersect a first surface of an edge of an aerofoil and arranging the second axis to intersect a second surface of the edge of the aerofoil, d) moving the first brush such that the first brush contacts the first surface of the edge and moving the second brush such that the second brush contacts the second surface of the edge e) producing relative movement between the first brush and the second brush and the aerofoil such that the first brush and the second brush move longitudinally along the edge of the aerofoil to shape the edge of the aerofoil.

The method may comprise a) providing a plurality of first brushes and a plurality of second brushes, each brush comprising a plurality of bristles extending substantially parallel to each other, b) rotating each first brush about a respective first axis and rotating each second brush about a respective second axis, each first axis being arranged substantially parallel to the bristles of the respective first brush and each second axis being arranged substantially parallel to the bristles of the respective second brush, c) arranging each first axis to intersect a first surface of an edge of an aerofoil and arranging each second axis to intersect a second surface of the edge of the aerofoil, d) moving the first brushes such that the first brushes contact the first surface of the edge and moving the second brushes such that the second brushes contact the second surface of the edge e) producing relative movement between the first brushes and the second brushes and the aerofoil such that the first brushes and the second brushes move longitudinally along the edge of the aerofoil to shape the edge of the aerofoil.

The method may comprise arranging each first axis and each second axis to intersect the first and second surfaces respectively at angle in the range of 30° to 75°.

The method may comprise arranging each first axis and each second axis to intersect the first and second surfaces respectively at angle in the range of 30° to 75°.

The method may comprise arranging each first axis and each second axis to intersect the first and second surfaces respectively at angle of 60°.

The method may comprise varying the angle at which each first axis and each second axis intersect the first and second surfaces respectively.

Each first brush may comprise alumina bristles or silicon carbide bristles. Each second brush may comprise alumina bristles or silicon carbide bristles.

The method may comprise arranging the first axis and the second axis in a plane.

Alternatively the method may comprise arranging the first axis and the second axis in two parallel planes.

The method may comprise shaping the leading edge of an aerofoil. The method may comprise reshaping an edge of a worn aerofoil.

The method may comprise shaping the edge of a gas turbine engine aerofoil. The method may comprise shaping the edge of a fan blade, a fan outlet guide vane, a compressor blade or a compressor vane. The method may comprise shaping the edge of a blade on an integrally bladed disc, shaping the edge of a blade mounted in a slot in the periphery of rotor disc or shaping the edge of a blade mounted in a slot in the periphery of a rotor drum. The method may comprise shaping the edge of the aerofoil while the aerofoil is in the gas turbine engine.

Alternatively the method may comprise shaping the edge of a steam turbine aerofoil, a water turbine aerofoil, a wind turbine aerofoil etc.

The present invention also provides an apparatus for shaping an edge of a component, the apparatus comprising a first brush and a second brush, each brush comprising a plurality of bristles extending substantially parallel to each other, a first device arranged to rotate the first brush about a first axis, the first axis being arranged substantially parallel to the bristles of the first brush, a second device arranged to rotate the second brush about a second axis, the second axis being arranged substantially parallel to the bristles of the second brush, a support structure arranged to hold the first brush such that the first axis intersects a first surface of an edge of a component and arranged to hold the second brush such that the second axis intersects a second surface of the edge of the component, means to move the first brush such that the first brush contacts the first surface of the edge and means to move the second brush such that the second brush contacts the second surface of the edge, means to produce relative movement between the first brush and the second brush and the component such that the first brush and the second brush move longitudinally along the edge of the component to shape the edge of the component.

The present invention also provides a method of shaping an edge of a component, the method comprising a) providing a first brush and a second brush, each brush comprising a plurality of bristles extending substantially parallel to each other, b) rotating the first brush about a first axis and rotating the second brush about a second axis, the first axis being arranged substantially parallel to the bristles of the first brush and the second axis being arranged substantially parallel to the bristles of the second brush, c) arranging the first axis to intersect a first surface of an edge of a component and arranging the second axis to intersect a second surface of the edge of the component, d) moving the first brush such that the first brush contacts the first surface of the edge and moving the second brush such that the second brush contacts the second surface of the edge e) producing relative movement between the first brush and the second brush and the component such that the first brush and the second brush move longitudinally along the edge of the component to shape the edge of the component.

The present invention will be more fully described by way of example with reference to the accompanying drawings, in which:—

Figure 1:
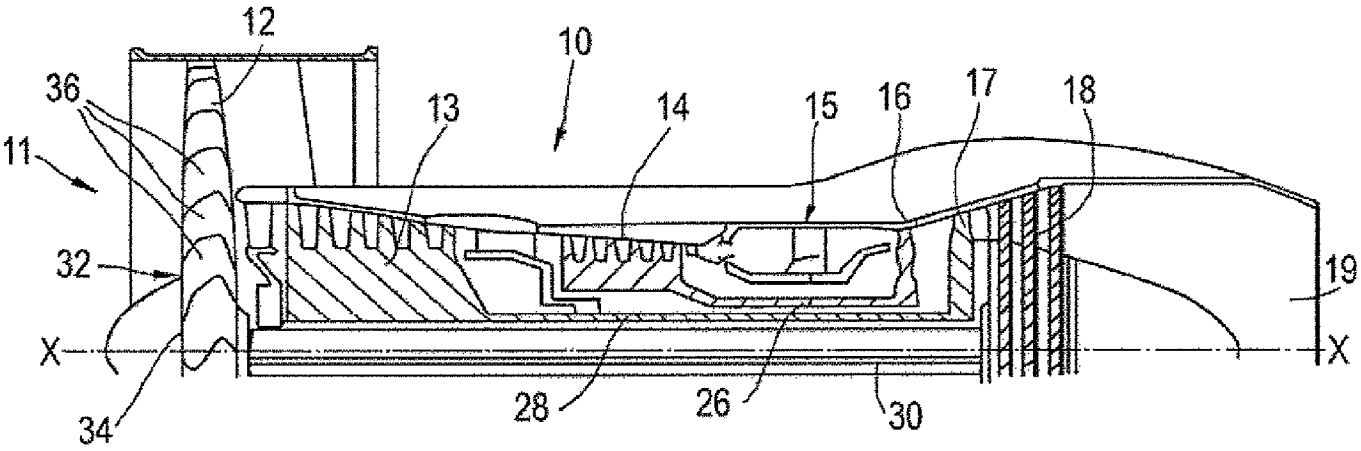
FIG. 1 is a cross-sectional view of an upper half of a turbofan gas turbine engine showing a fan blade which has a leading edge which has been shaped using a method according to the present invention.

A turbofan gas turbine engine 10, as shown in FIG. 1, comprises in flow series an intake 11, a fan 12, an intermediate pressure compressor 13, a high pressure compressor 14, a combustor 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 14 via a second shaft 28 and the low pressure turbine 19 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustor 15. Fuel is injected into the combustor 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
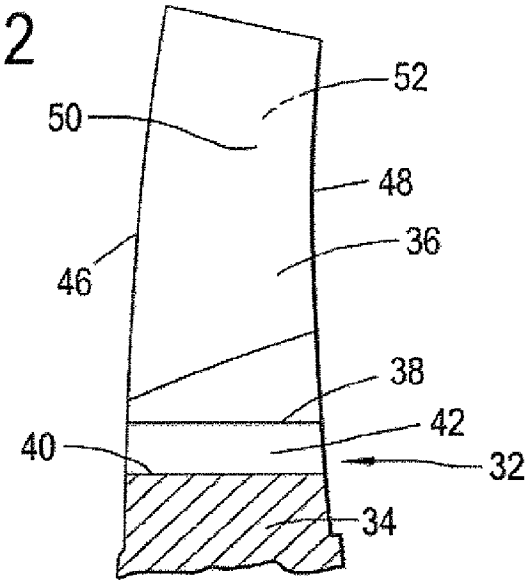
FIG. 2 is an enlarged cross-sectional view through a portion of a fan rotor assembly showing a fan blade which has a leading edge which has been shaped using a method according to the present invention.

The fan 12, as shown in FIG. 2, comprises a fan rotor assembly 32 comprising a fan rotor, a fan disc, 34 and a plurality of circumferentially spaced radially outwardly extending fan rotor blades 36. The fan rotor, fan disc, 34 has a rim 38 and a plurality of circumferentially spaced slots 40 are provided in the rim 38 of the fan rotor, fan disc 34. Each fan rotor blade 36 has a root 42 and the root 42 of each fan rotor blade 36 is arranged in a corresponding one of the slots 40 in the rim 38 of the fan rotor, fan disc 34. The root 42 of each fan rotor blade 36 is firtree shaped, or dovetail shaped, in cross-section and each slot 40 is correspondingly shaped to receive the root 42 of the corresponding fan rotor blade 36. Alternatively the fan rotor blades 36 are integral with the fan rotor, fan disc, 34 and the fan rotor blades 36 are friction welded, laser welded, electron beam welded or diffusion bonded to the periphery of the fan rotor, fan disc, 34.

Each fan rotor blade 36 also has an aerofoil 44 and the aerofoil 44 of each fan rotor blade 36 has a leading edge 46, a trailing edge 48, a convex suction surface 50 extending from the leading edge 46 to the trailing edge 48 and a concave pressure surface 52 extending from the leading edge 46 to the tailing edge 48. The leading edge 46 of the aerofoil 44 of each fan rotor blade 36 is generally elliptical in profile, but other suitable shapes may be used.

As mentioned previously the leading edges 46 of the aerofoils 44 of the fan rotor blades 36 suffer from erosion during operation of the turbofan gas turbine engine 10 and the aerodynamic efficiency and surge margin of the fan 12 is reduced. Thus, it is desirable to restore the leading edges 46 of the aerofoils 44 of the fan rotor blades 36 back to their original shape.

Figure 8:
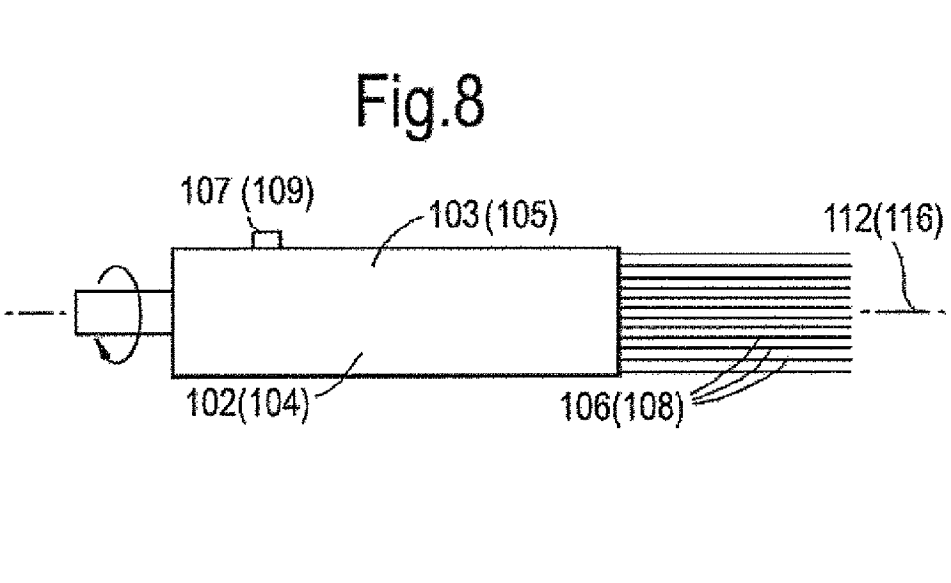
FIG. 8 is an enlarged view of a brush.
Figure 3:
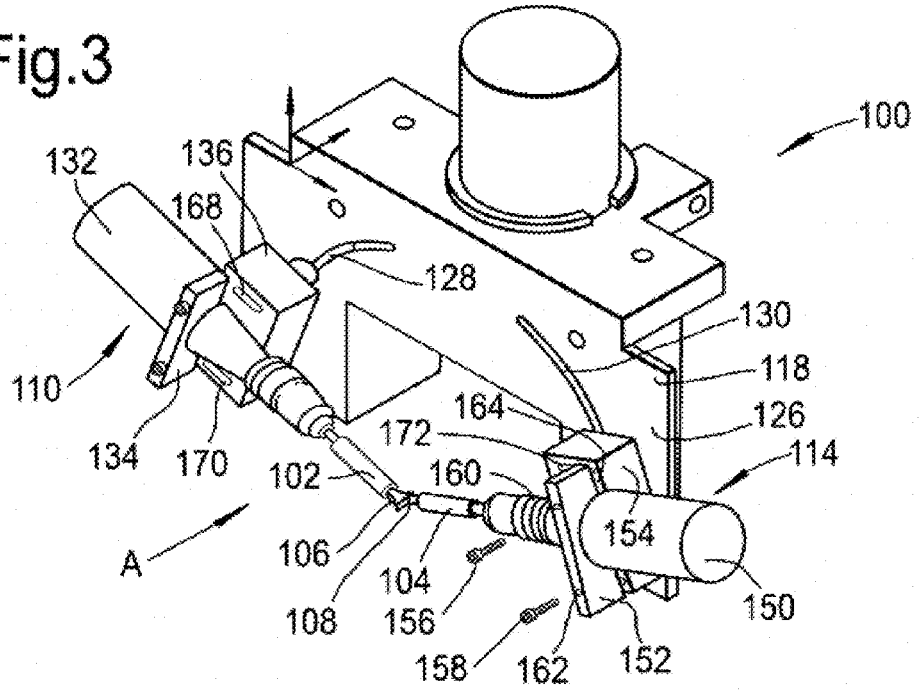
FIG. 3 is a perspective view of an apparatus for shaping an edge of an aerofoil according to the present invention.
Figure 5:
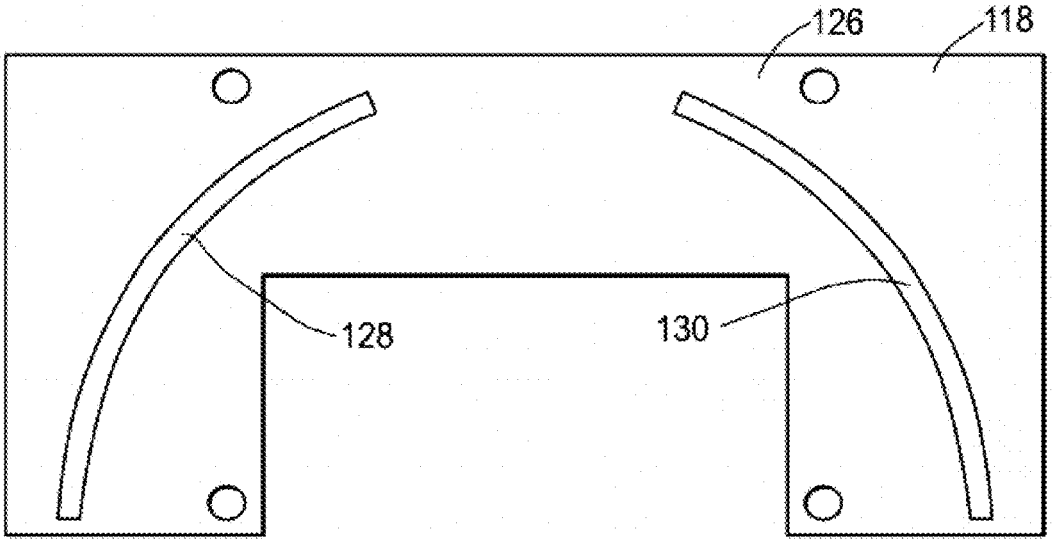
FIG. 5 is a view in the direction of arrow A in FIG. 3 showing a support structure of the apparatus for shaping an edge of an aerofoil.
Figure 6:
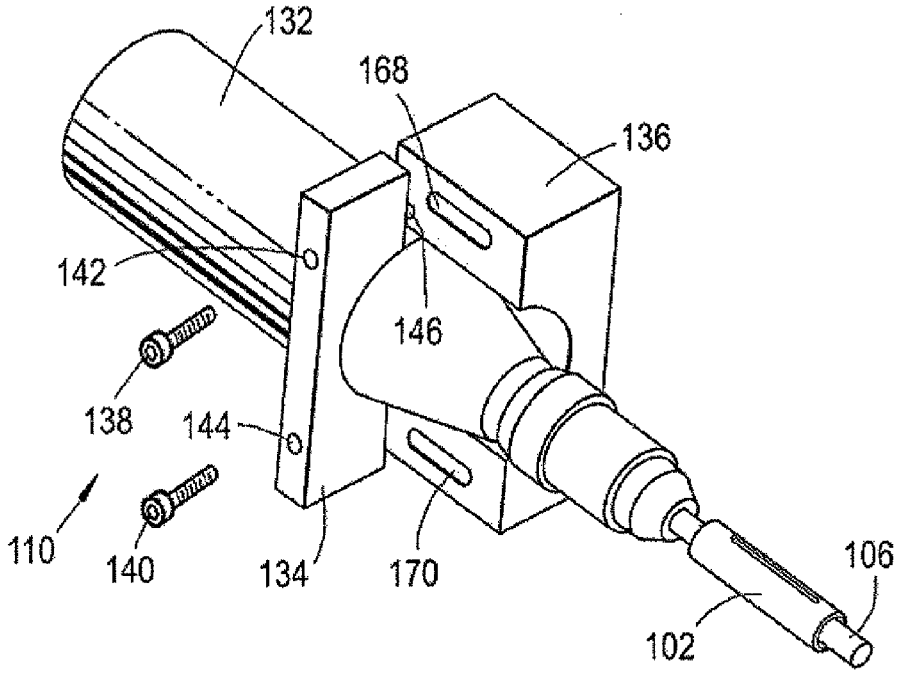
FIG. 6 is an enlarged perspective view of part of the apparatus shown in FIG. 3 showing a brush, a motor and a clamp.
Figure 7:
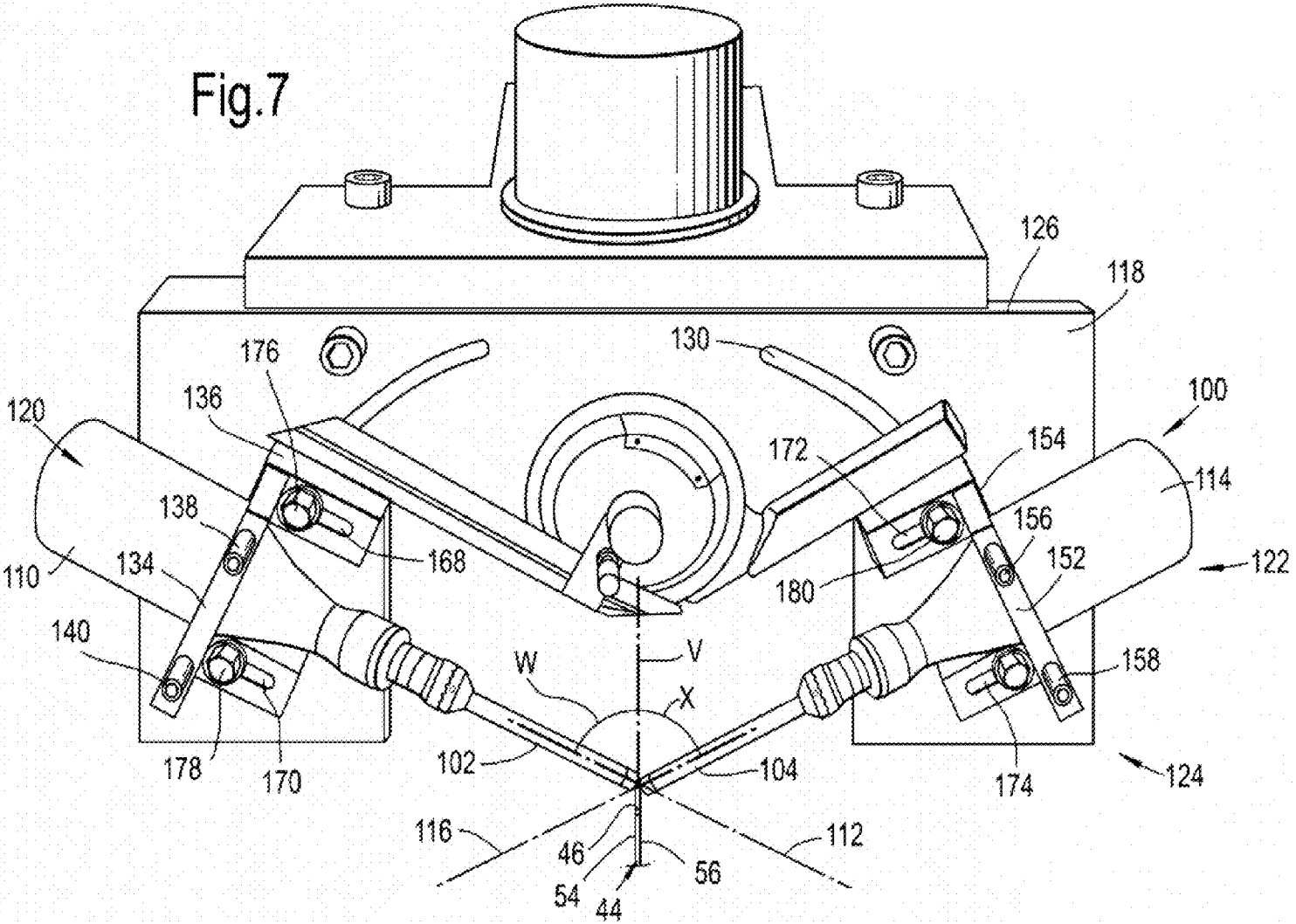
FIG. 7 is a view of the apparatus for shaping an edge of an aerofoil according to the present invention installed on a milling machine.

An apparatus 100 for shaping an edge 46 of an aerofoil 44, as shown in FIGS. 3 to 8 comprises a first brush 102 and a second brush 104. Each brush 102 and 104 comprises a plurality of bristles 106, 108 respectively. The bristles 106, 108 in each brush 102, 104 extend substantially parallel to each other, as shown in FIG. 8. A first motor 110 is arranged to rotate the first brush 102 about a first axis 112 and the first axis 112 is arranged substantially parallel to the bristles 106 of the first brush 102. A second motor 114 is arranged to rotate the second brush 104 about a second axis 116 and the second axis 116 is arranged substantially parallel to the bristles 108 of the second brush 104. A support structure 118 is arranged to hold the first brush 102 such that the first axis 112 intersects a first surface 54 of an edge 46 of an aerofoil 44 and the support structure 118 is arranged to hold the second brush 104 such that the second axis 116 intersects a second surface 56 of the edge 46 of the aerofoil 44. There are means 120 to position, or move, the first brush 102 such that the first brush 102 contacts the first surface 54 of the edge 46 of the aerofoil 44 and there are means 122 to position, or move, the second brush 104 such that the second brush 104 contacts the second surface 56 of the edge 46 of the aerofoil 44. There are means 124 to produce relative movement the first brush 102 and the second brush 104 and the aerofoil 44 such that the first brush 102 and the second brush 104 move longitudinally along the edge 46 of the aerofoil 44 to shape the edge 46 of the aerofoil 44. The first and second surfaces 54 and 56 meet at the leading edge 46 of the aerofoil 44. The support structure 118 comprises a first member, a plate member, 126 having a first curved slot 128 and a second curved slot 130, as shown in FIG. 5. A housing 132 of the first motor 110 is clamped between a first clamp member 134 and a second clamp member 136 using a first pair of fasteners, e.g. two bolts, 138 and 140 which pass through apertures 142 and 144 in the first clamp member 134 and are secured in respective aligned threaded apertures 146 and 148 in the second clamp member 136, as shown in FIGS. 3 and 6. A housing 150 of the second motor 114 is clamped between a third clamp member 152 and a fourth clamp member 154 using a second pair of fasteners, e.g. two bolts, 156 and 158 which pass through apertures 160 and 162 in the third clamp member 152 and are secured in respective aligned threaded apertures 164 and 166 in the fourth clamp member 154, as shown in FIG. 3. The second clamp member 136 has a first pair of parallel slots 168 and 170 and the fourth clamp member 154 has a second pair of parallel slots 172 and 174, as shown more clearly in FIG. 6. A third pair of fasteners, e.g. two nuts bolts, 176 and 178 extend through the first pair of parallel slots 168 and 170 and through the first curved slot 128 such that the first motor 110 and first brush 102 are movable in an arc along the first curved slot 128 to vary the angle of the axis of rotation 112 of the first brush 102 relative to the leading edge 46 of the aerofoil 44. A fourth pair of fasteners, e.g. two nuts and bolts, 180 and 182 extend through the second pair of parallel slots 172 and 174 and through the second curved slot 130 such that the second motor 114 and second brush 102 are movable in an arc along the second curved slot 130 to vary the angle of the axis of rotation 116 of the second brush 102 relative to the leading edge 46 of the aerofoil 44. The first pair of parallel slots 168 and 170 allow the first brush 102 and first motor 110 to be moved towards or away from the leading edge 46 of the aerofoil 44 by un-tightening the third pair of fasteners 176 and 178. The second pair of parallel slots 172 and 174 allow the second brush 104 and second motor 114 to be moved towards or away from the leading edge 46 of the aerofoil 44 by un-tightening the fourth pair of fasteners 180 and 182.

The support structure 118 is arranged to hold the first and second brushes 102 and 104 such that the first axis 112 and the second axis 116 intersect the first and second surfaces 54 and 56 respectively at angle in the range of 30° to 75°. The support structure 118 is arranged to hold the first and second brushes 102 and 104 such that the first axis 112 and the second axis 116 intersect the first and second surfaces 54 and 56 respectively at angle in the range of 55° to 75°. The support structure 118 is arranged to hold the first and second brushes 102 and 104 such that the first axis 112 and the second axis 116 intersect the first and second surfaces 54 and 56 respectively at angle of 60°.

The support structure 118 comprises an adjuster to vary the angle at which the first axis 112 and the second axis 116 of the first and second brushes 102 and 104 intersect the first and second surfaces 54 and 56 respectively. The adjuster comprises the first curved slot 128, the second curved slot 130, the third pair of fasteners 176 and 178 and the fourth pair of fasteners 180 and 182.

The first brush 102 and/or the second brush 104 comprise alumina bristles 106, 108, but other suitable abrasive bristles may be used. The first and second brushes 102 and 104 may comprise XEBEC® brushes obtained is from Xebec Technology Co, Japan, and especially XEBEC® A21 white brushes, which comprise a sleeve 103, 105 in which the bristles 106, 108 are held and the free length of the bristles 106, 108 extending from sleeves 103, 105 is adjustable using a screw 107, 109 as shown in FIG. 8.

The first motor 110 and/or the second motor 114 may comprise an electric motor, a hydraulic motor or a pneumatic motor.

Figure 4:
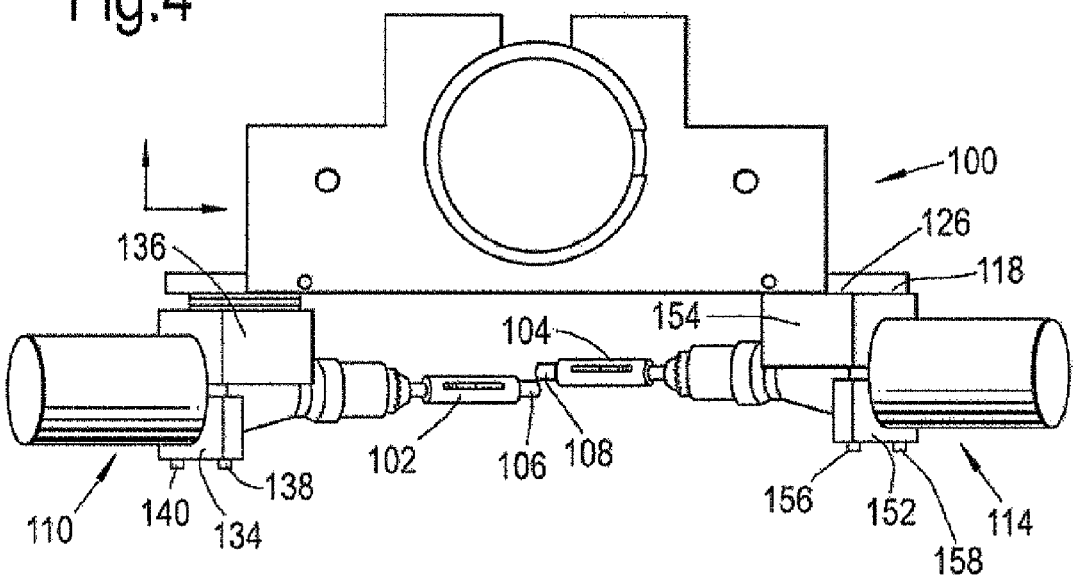
FIG. 4 is a plan view of the apparatus for shaping an edge of an aerofoil shown in FIG. 3.

The first axis 112 and the second axis 114 may be arranged in a common plane, alternatively the first axis 112 and the second axis 114 may be arranged in two parallel planes as shown in FIG. 4. The first brush 102 and the second brush 104 may be arranged to rotate in opposite directions to prevent damage to the first brush 102 and/or damage to the second brush 104 if there is a possibility that the bristles of the first and second brushes 102 and 104 may contact each other. The first brush 102 and the second brush 104 may be arranged to rotate in the same direction if there is no possibility that the bristles of the first and second brushes 102 and 104 may contact each other.

The apparatus 100 may be mounted on a milling machine and an aerofoil 44 may be held by the milling machine. As seen in FIG. 6, the aerofoil 44 is held such that it extends substantially vertically from the milling machine and the edge 46 extends substantially horizontally. In operation, initially the first axis 112 is arranged to intersect the first surface 54 of the edge 46 of the aerofoil 44 and the second axis 116 is arranged to intersect the second surface 56 of the edge 46 of the aerofoil 44. Then the first brush 102 is positioned, or moved, such that the first brush 102 contacts the first surface 54 of the edge 46 of the aerofoil 44 and the second brush 104 is positioned, moved, such that the second brush 104 contacts the second surface 56 of the edge 46 of the aerofoil. Then the first brush 102 is rotated about the first axis 112 and the second brush 104 is rotated about the second axis 116 and relative movement is provided between the first brush 102 and the second brush 104 on the one hand and the aerofoil 44 on the other hand such that the first brush 102 and the second brush 104 move longitudinally along the edge 46 of the aerofoil 14 to shape the edge 46 of the aerofoil 44 and in particular shape the first surface 54 and the second surface 56 of the edge 46 of the aerofoil 44. Either the first and second brushes 102 and 104 and support structure 118 are held stationary and the aerofoil 44 is moved is or the first and second brushes 102 and 104 and support structure 118 are moved and the aerofoil 44 is held stationary. The first and second axes 112 and 116 may arranged at the same angle to a vertical line V extending from the edge 46 of the aerofoil 44 and are arranged at angles W and X in the range of 30° to 75°, preferably 55° to 75°, relative to the vertical line V and the first and second axes 112 and 116 may both be arranged at angles W and X of 60° relative to the vertical line V. The first axis 112 and the second axis 114 are arranged in two parallel planes such that the first and second brushes 102 and 104 do not interfere with each other. The first and second axes 112 and 116 may arranged at different angles to a vertical line V extending from the edge 46 of the aerofoil 44 if the edge 46 of the aerofoil 44 is asymmetric, due to the design of the aerofoil 44 or by preferential erosion of one side of the edge 46 of the aerofoil 44.

The rotational speed of the first and second brushes 102 and 104 may be varied, the first and second brushes 102 and 104 may be moved towards or away from the edge 46 of the aerofoil 44 to take into account the thickness of the aerofoil 44 and the angle of the axes of rotation 112 and 116 of the first and second brushes 102 and 104 may be varied to allow different profiles, different ellipses, to be produced at the edge 46 of the aerofoil 44. The angle of the brushes with respect to the aerofoil, the free length of the bristles, the overall depth of cut of the brushes against the aerofoil, the number of cuts of the brushes along the edge of the aerofoil at different positions relative to the aerofoil, the number of passes of the brushes along the edge of the aerofoil at the same position relative to the aerofoil, the rotational speed of the brushes and the feed rate, the speed, at which the brushes move along the edge of the aerofoil may all be varied to vary the ellipse ratio for the edge of the aerofoil. Changing the angle of the brushes has a significant effect on the ellipse ratio. Changing the angle of the brushes changes the ellipse ratio and in particular increasing the angle of the brushes increases the ellipse ratio.

In one example the brushes were set at an angle of 60°, the feed rate was 200 mm/min, the brush rotation speed was 3000 rpm, number of passes was 4, number of stages was 4, the depth of cut was 0.53 mm, effective depth of cut was 0.265 mm and the brushes were XEBEC A21 brushes.

The method may comprise shaping the edge of a gas turbine engine aerofoil. The method may comprise shaping the edge of a fan blade, a fan outlet guide vane, a compressor blade or a compressor vane. The method may comprise shaping a leading edge of an aerofoil, e.g. a blade or a vane. The aerofoil may comprise a titanium alloy, a nickel or steel. An example of a titanium alloy is titanium 6-4 consisting of 6 wt % aluminium, 4 wt % vanadium and the balance titanium plus incidental impurities and minor additions. An example of a nickel alloy is Inconel 718.

The method may comprise reshaping an edge of a worn aerofoil. The method may comprise shaping the edge of the aerofoil while the aerofoil is in the gas turbine engine. The aerofoil may be an aerofoil of integrally bladed disc or a separate aerofoil mounted in a slot in the periphery of a disc or separate aerofoil mounted in a slot in the periphery of a drum. The method may comprise removing a casing from gas turbine engine and then shaping the aerofoil while the aerofoil is on an integrally bladed disc or while the aerofoil is mounted in a slot in the periphery of a disc or while the aerofoil is mounted in a slot in the periphery of a drum of the gas turbine engine. The method may comprise mounting the apparatus on an aerofoil and then moving the brushes along the edge of the aerofoil. The method may comprise passing the brushes through an aperture in a casing with a boroscope and shaping the edge of an aerofoil while the aerofoil is in the gas turbine engine and in this case the brushes and associated structures and drives etc may be miniaturised.

Although the present invention has been described with reference to the use of a first motor to drive the first brush directly and a second motor arranged to drive the second brush directly, it may be possible to provide other arrangements to drive the first brush and the second brush, e.g. a first device and a second device respectively. The first device may comprise a first motor arranged to drive the first brush via gears and the second device may comprise a second motor arranged to drive the second brush via gears. Alternatively the first device and the second device may share a single motor which is arranged to drive both the first device and the second device.

Although the present invention has been described with reference to the use of a plate with curved slots to enable adjustment of the first and second angles of the first and second brushes respectively it is equally possible to use other suitable devices, e.g. first and second curved tracks along which the first and second brushes may move.

Although the present invention has been described with reference to a first brush arranged such that the first axis intersects a first surface of an edge of an aerofoil and a second brush arranged such that the second axis intersects a second surface of the edge of the aerofoil it is equally possible to provide a plurality of first brushes arranged such that the axis of each of the first brushes intersect a first surface of an edge of an aerofoil and a plurality of second brushes arranged such that the axis of each of the second brushes intersect a second surface of the edge of the aerofoil. The axes of the first brushes may be parallel and the axes of the second brushes may be parallel.

The present invention is equally applicable to aerofoils for other gas turbine engines, e.g. turbojet, turboprop and turboshaft gas turbine engines and for gas turbine engine with one, two or more shafts. The present invention is equally applicable for shaping edges, e.g. leading edges, of blades or vanes.

The invention claimed is:

1. A method of shaping an edge of an aerofoil, the method comprising:— a) providing a first brush and a second brush, each brush comprising a plurality of bristles extending substantially parallel to each other, b) rotating the first brush about a first axis and rotating the second brush about a second axis, the first axis being arranged substantially parallel to the bristles of the first brush and the second axis being arranged substantially parallel to the bristles of the second brush, c) arranging the first axis to intersect a first surface of an edge of an aerofoil and arranging the second axis to intersect a second surface of the edge of the aerofoil, d) moving the first brush such that the first brush contacts the first surface of the edge and moving the second brush such that the second brush contacts the second surface of the edge, e) producing relative movement between the first brush and the second brush and the aerofoil such that the first brush and the second brush move longitudinally along the edge of the aerofoil to shape the edge of the aerofoil.

2. A method as claimed in claim 1 comprising arranging the first axis and the second axis to intersect the first and second surfaces respectively at angle in the range of 30° to 75°.

3. A method as claimed in claim 2 comprising arranging the first axis and the second axis to intersect the first and second surfaces respectively at angle in the range of 55° to 75°.

4. A method as claimed in claim 3 comprising arranging the first axis and the second axis to intersect the first and second surfaces respectively at angle of 60°.

5. A method as claimed in claim 1 comprising varying the angle at which the first axis and the second axis intersects the first and second surfaces respectively.

6. A method as claimed in claim 1 wherein the bristles are selected from the group comprising alumina bristles and silicon carbide bristles.

7. A method as claimed in claim 1 comprising arranging the first axis and the second axis in a plane.

8. A method as claimed in claim 1 comprising arranging the first axis and the second axis in two parallel planes.

9. A method as claimed in claim 1 wherein the edge of the aerofoil is a leading edge.

10. A method as claimed in claim 1 wherein the aerofoil is worn, and the method further comprising reshaping the edge.

11. A method as claimed in claim 1 wherein the aerofoil is a gas turbine engine aeroloil.

12. A method as claimed in claim 11 wherein the gas turbine engine aerofoil is selected from the group comprising a fan blade, a fan outlet guide vane, a compressor blade and a compressor vane.

13. A method as claimed in claim 11 wherein the aerofoil is selected from the group comprising a blade on an integrally bladed disc, a blade mounted in a slot in the periphery of a rotor disc and a blade mounted in a slot in the periphery of a rotor drum.

* * * * *